US007266051B2

(12) United States Patent
Plancon et al.

(10) Patent No.: US 7,266,051 B2
(45) Date of Patent: Sep. 4, 2007

(54) METHOD AND CONSTRUCTION FOR AUTOCALIBRATING AN ACTUATION MECHANISM IN AN ELECTRONIC DEVICE

(75) Inventors: Michel G. Plancon, Besancon (FR); Helmut Zachmann, Remchingen (DE); Gerhard Stotz, Eisingen (DE)

(73) Assignee: Timex Group B.V. (NL)

( * ) Notice: Subject to any disclaimer, the term of this patent is extended or adjusted under 35 U.S.C. 154(b) by 281 days.

(21) Appl. No.: 10/737,406

(22) Filed: Dec. 16, 2003

(65) Prior Publication Data

US 2004/0233791 A1 Nov. 25, 2004

Related U.S. Application Data

(60) Provisional application No. 60/472,042, filed on May 20, 2003.

(51) Int. Cl.
*G04B 19/04* (2006.01)

(52) U.S. Cl. ..... 368/80; 368/223

(58) Field of Classification Search ..... 368/80, 368/223, 81, 224–225, 228, 157, 160
See application file for complete search history.

(56) References Cited

U.S. PATENT DOCUMENTS 4,314,146 A 2/1982 Berney
5,119,349 A * 6/1992 Muto et al. ..... 368/157
5,335,211 A 8/1994 Muto et al.
5,673,238 A 9/1997 Berney

FOREIGN PATENT DOCUMENTS

EP 0122621 10/1984
JP 2003-107174 4/2003

* cited by examiner

*Primary Examiner*—Vit Miska
*Assistant Examiner*—Sean Kayes
(74) *Attorney, Agent, or Firm*—Carmody & Torrance LLP

(57) ABSTRACT

A method of calibrating a display hand in an electronic device. The preferred method comprises the steps of initializing a counter; stepping the rotor of the stepping motor a predetermined number of steps in a first direction and incrementing the counter; determining whether the counter is less than a predefined value representing at least the total of (i) the maximum number of steps needed from a zero position on the display to the maximum value on the display; and (ii) the number of steps needed from the zero position on the display to the position such that a channel formed in one of the one or more gears would abut against a tab; and if so, stepping the rotor of the stepping motor the predetermined number of steps in the first direction, incrementing the counter and again determining whether the counter is less than the predefined value; and if not, rotating the rotor of the motor in a direction opposite the first direction the same number of steps needed from the zero position on the display to the position such that the channel would abut against the tab. Several calibration assembly constructions are also provided.

10 Claims, 5 Drawing Sheets

METHOD AND CONSTRUCTION FOR AUTOCALIBRATING AN ACTUATION MECHANISM IN AN ELECTRONIC DEVICE

RELATED U.S. APPLICATION DATA

This application claims the benefit of U.S. Provisional Application No. 60/472,042 filed on May 20, 2003.

BACKGROUND OF THE INVENTION

This invention relates generally to wearable electronic devices, such as timepieces, and in particular, to an electronic device, such as for example and not limitation, a watch, that may have multiple display functionality. Specifically, the present invention is directed to methodologies and constructions for automatically calibrating the positioning of the one or more display hands which are used for displaying information in analog watches (i.e. in an "analog manner").

Specifically, the present invention by way of example and not limitation, may be incorporated into the devices disclosed and claimed in copending and coowned application Ser. No. 10/441,417, entitled WEARABLE ELECTRONIC DEVICE WITH MULTIPLE DISPLAY FUNCTIONALITY, naming inventors M. Plancon, H. Schwartz, G. Stotz and L. Galie and having a filing date of this May 20, 2003), the subject matter of which is incorporated by reference as if fully set forth herein.

By way of background, it is believed that the present state of the art for calibrating the positioning of a display hand, such as chronograph displays (i.e. the displays at the 2:00 and/or 10:00 positions) is to mechanically decouple, such as by the pulling of the crown, the display hands from their associated gear train, and then manually adjust the position of the hand, such as by rotation of a crown or the like. Thereafter, mechanically recoupling the gear train to the display hands will once again allow the display hands to rotate. In the prior art however, it is unnecessary for the controller to "know" the position of the display hands, since the display hands merely rotate with the passage of time. Hence, manual calibration is sufficient.

On the other hand, in electronic devices such as those disclosed herein, it is desirable for the controller to "know" where the display hand(s) are to ensure accurate displaying and conveying of information. Hence, accurate calibration of the display hand is important.

It would be desirable to perform this operation automatically, thus ensuring both accuracy and improved ease with which the operation is performed.

Accordingly, it can be seen that further advancements in the art are desired. It is believed that the constructions and methodology to provide the foregoing advantages and achieve the aforementioned objectives, as well as those set forth below, are provided by the present invention.

SUMMARY AND OBJECTIVES OF THE INVENTION

It is thus an objective of the present invention to overcome the perceived deficiencies in the prior art.

It is another objective and advantage of the present invention to provide an improved method of automatically calibrating a display hand in an electronic device, and also to provide improved constructions to carry out such methodologies.

Further objects and advantages of this invention will become more apparent from a consideration of the drawings and ensuing description.

The invention accordingly comprises the features of construction, combination of elements and arrangement of parts and sequence of steps that will be exemplified in the disclosure hereinafter set forth, and the scope of the invention will be indicated in the claims.

To overcome the perceived deficiencies in the prior art and to achieve the objects and advantages set forth above and below, the present invention is, generally speaking, directed to a method of calibrating a display hand in an electronic device. The preferred method comprises the steps of initializing a counter; stepping the rotor of the stepping motor a predetermined number of steps in a first direction and incrementing the counter; determining whether the counter is less than a predefined value representing at least the total of (i) the maximum number of steps needed from an initial (e.g. zero) position on the display to the maximum value on the display; and (ii) the number of steps needed from the initial position on the display to the position such that a channel formed in one of the one or more gears would abut against a tab; and if so, stepping the rotor of the stepping motor the predetermined number of steps in the first direction, incrementing the counter and again determining whether the counter is less than the predefined value; and if not, rotating the rotor of the motor in a direction opposite the first direction the same number of steps needed from the initial position on the display to the position such that the channel would abut against the tab.

A calibration assembly is also provided. In one embodiment, the calibration assembly comprises a controller for providing signals; a stepper motor operatively coupled to the controller and responsive to the signals, for rotating the at least one display hand in at least one of a clockwise and counterclockwise direction in predefined increments; one or more gears for operatively coupling the rotor of the stepper motor to the display hand, wherein a channel is formed within at least one of the one or more gears; and wherein a tab is provided and positioned to be abuttable against an edge of the channel; such that when the controller causes the rotor to rotate in a predetermined direction to cause the tab to abut against the edge of the channel, the position of the display hand is in an initialized position.

In another embodiment, the calibration assembly comprises a controller for providing signals; a stepper motor operatively coupled to the controller and responsive to the signals, for rotating the at least one display hand in at least one of a clockwise and counterclockwise direction in predefined increments; one or more gears for operatively coupling the rotor of the stepper motor to the display hand, wherein at least one of the one or more gears includes a tab extending therefrom; and wherein a stopper is provided and positioned to be abuttable against the tab; such that when the controller causes the rotor to rotate in a predetermined direction to cause the tab to abut against the stopper, the position of the display hand is in an initialized position. In yet another embodiment, a method of calibrating a display hand in this latter construction is also provided.

BRIEF DESCRIPTION OF THE DRAWINGS

The above set forth and other features of the invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DESCRIPTION OF THE PREFERRED EMBODIMENTS

1. General Overview

Again, it should be understood that the subject matter of copending and coowned application Ser. No. 10/441,417, entitled WEARABLE ELECTRONIC DEVICE WITH MULTIPLE DISPLAY FUNCTIONALITY, naming inventors M. Plancon, H. Schwartz, G. Stotz and L. Galie and having a filing date of this May 20, 2003) is incorporated by reference as if fully set forth herein.

Figure 1:
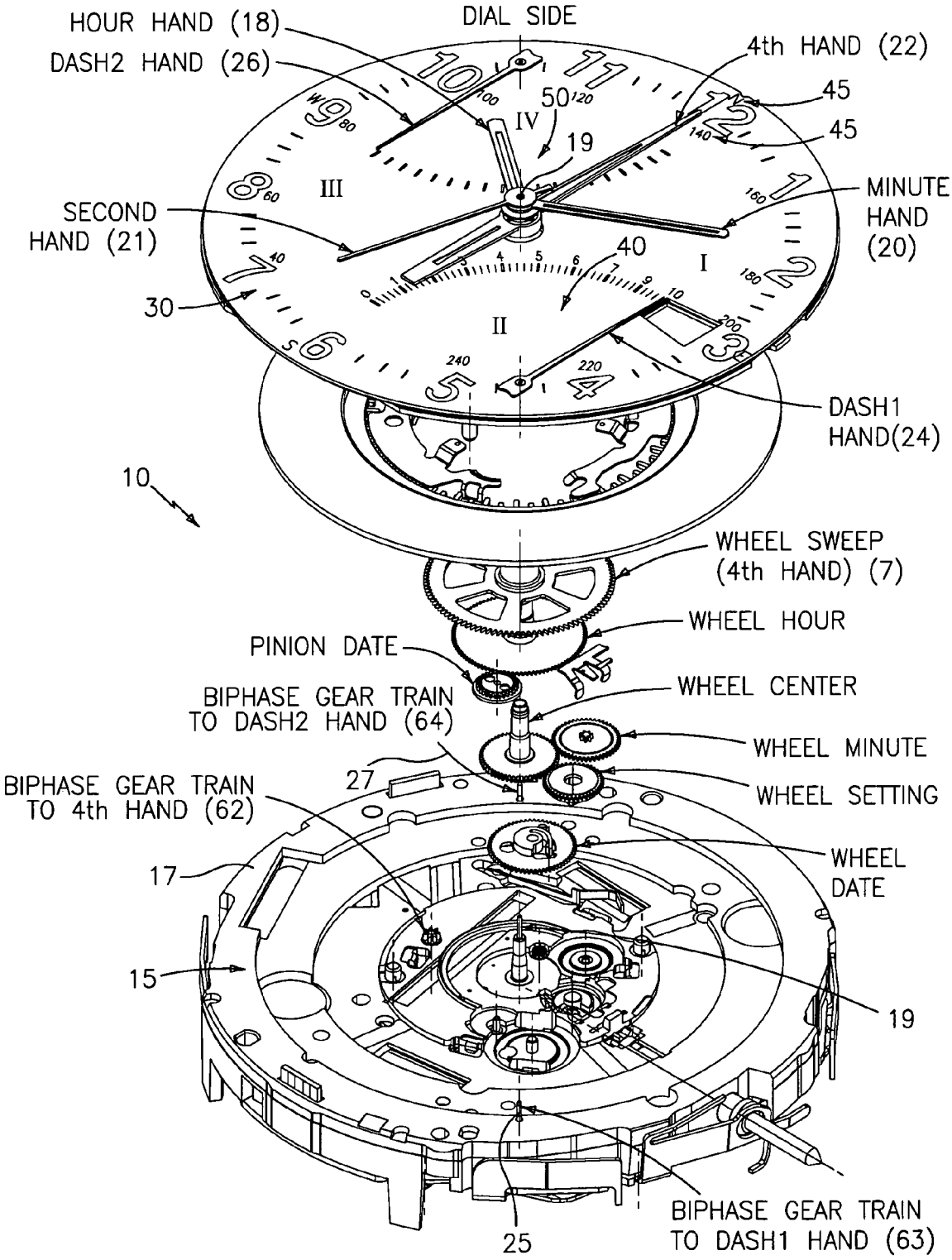
FIG. 1 is an exploded view of an electronic device constructed in accordance with the present invention.
Figure 2:
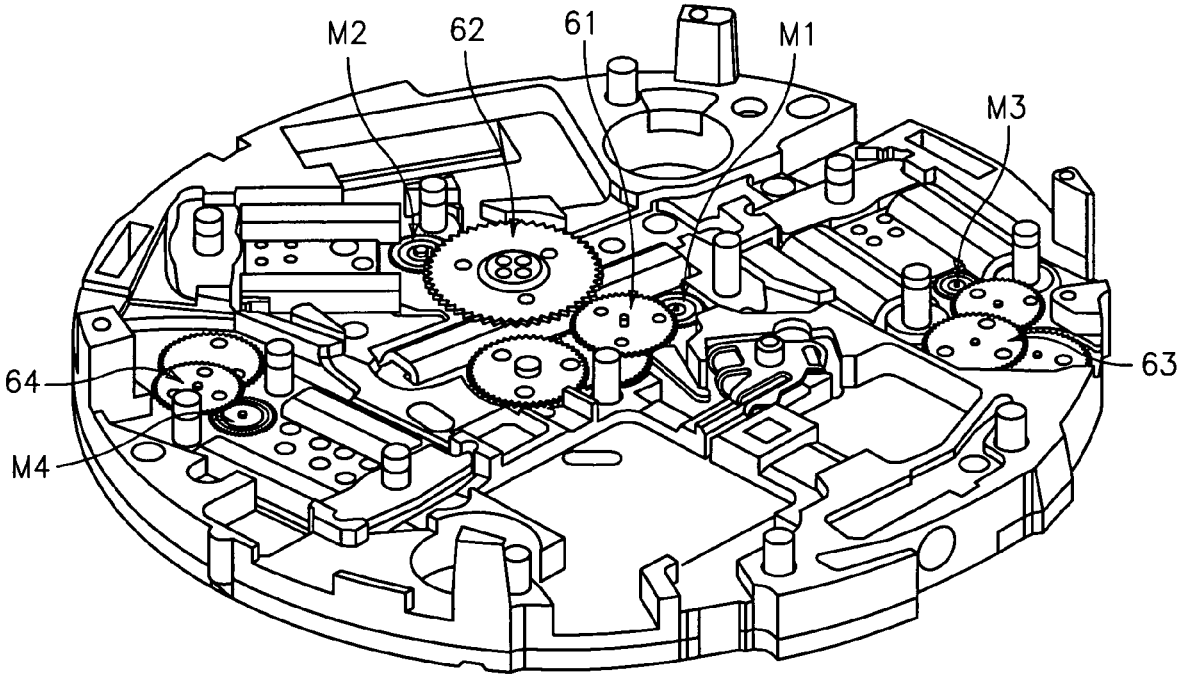
FIG. 2 is a perspective view of the movement side of the module in the electronic device of FIG. 1.
Figure 3:
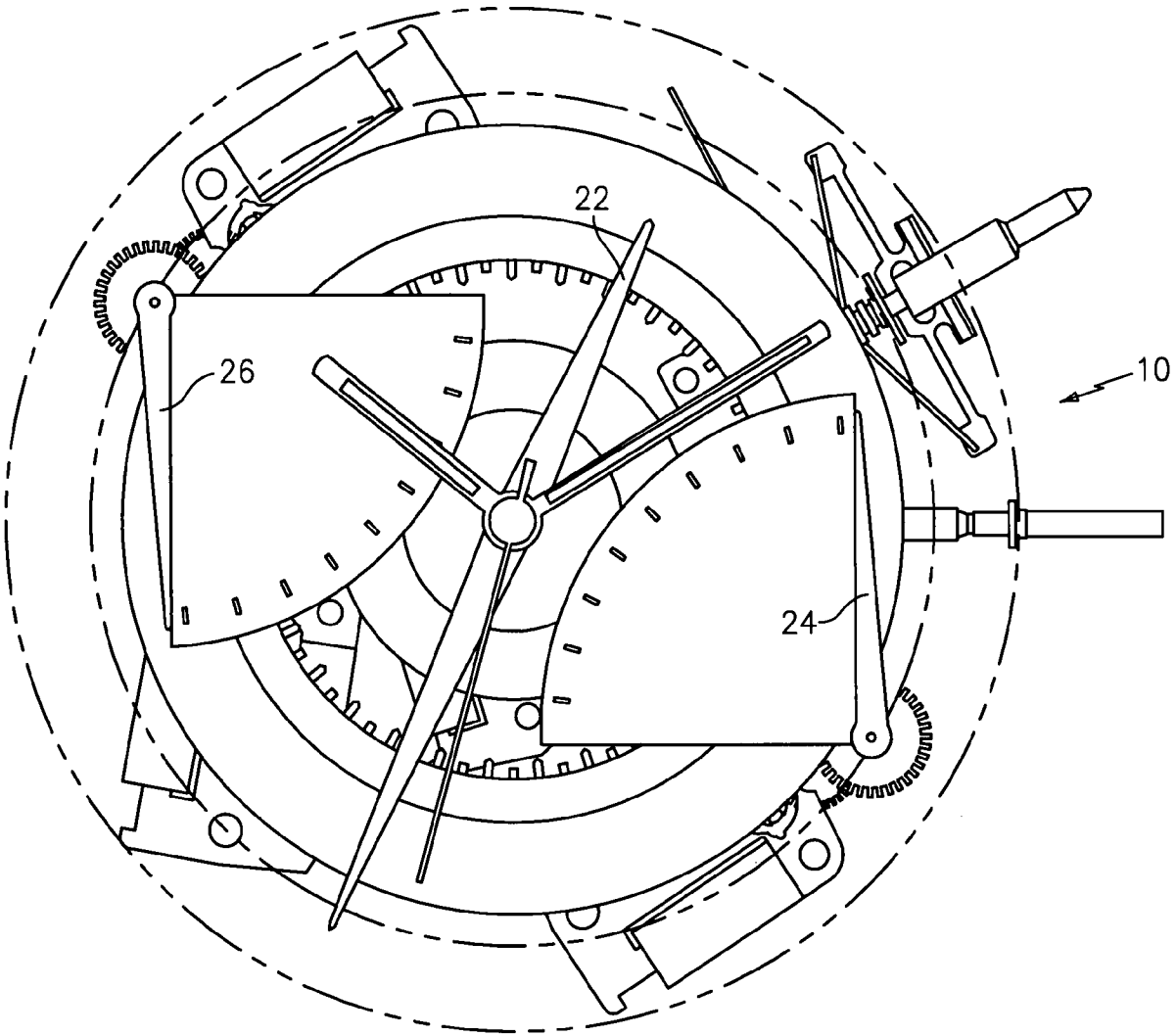
FIG. 3 is a transparent top plan view of an electronic device constructed in accordance with the present invention.

Reference is first made to FIGS. 1-3, which illustrate an electronic device, generally indicated at 10, constructed in accordance with the present invention. In the preferred construction, electronic device 10 is a timepiece, such as a wristwatch.

Generally speaking, electronic device 10 comprises a module, generally indicated at 15, which itself includes a housing 17, in which are disposed many components, the material ones of which pertain to the present invention being hereinafter disclosed. However, it should be understood that the present disclosure will omit, for purposes of brevity, certain basic and very well known concepts regarding the construction of an analog or chronograph watch. For example, the basic construction and arrangements of gears and/or gear trains to rotate a plurality of "standard" hands all supported on a center stem 19, such as an hour hand 18, a minute hand 20 and a "seconds" hand 21, will be omitted as being well within the purview of one skilled in the art. Similarly, disclosure of the manual setting of such hands and the incorporation and construction of a preferred date wheel, are omitted herein as they form no part of the present invention, although reference may be had to application Ser. Nos. 10/334,025; 10/331,827; and 10/342,512, assigned to the present assignee and incorporated by reference as if fully set forth herein, for a description of preferred setting mechanisms and date wheel constructions. However, for purposes of supporting the claims and providing an enabling disclosure, certain parts of such well-known mechanisms will be referenced throughout.

Electronic device 10 comprises a dial, generally indicated at 30, made of Mylar or another suitable plastic. Dial 30 preferably has numerals, such as 1-12 corresponding to "hours" designations, printed, silk-screened or otherwise formed thereon. Other indicia to assist in telling time may also be provided on dial 30.

For purposes of describing the present invention, dial 30 may be thought of as being divided into quadrants. In this way, the electronic device construction illustrated in FIG. 1 can be seen to be provided with at least two other displays, the first being generally indicated at 40 and generally located in quadrant II, while another display area being generally indicated at 50 and generally located in quadrant IV. However, the locations of such display 40, 50 is one of design choice and only limited by the needed spacing for stepper motors and associated gear trains, since such displays could also be provided in opposing quadrants I & III, or in adjacent ones as well.

Yet another display may be provided on dial 30. This display is illustrated in FIG. 1, and uses indicia provided on and about dial 30, such as for example, around the periphery thereof. This display, denoted display 45, may be associated with compass directions or, more relevant to the present invention, a heart rate range as more fully disclosed in the aforementioned application entitled "WEARABLE ELECTRONIC DEVICE WITH MULTIPLE DISPLAY FUNCTIONALITY".

Preferably, each display 40, 45 and 50 has its own scale or other information indicia printed, silk-screened or otherwise provided on dial 30, and the demarcations of such scales are one of design choice and a function of the parameter(s) being measured or otherwise displayed.

As can also be seen in FIG. 1, electronic device 10 may comprise one or more "display hands" aside from the conventional hour, minute and "seconds" hand. For example, FIG. 1 illustrates (i) a hand 22 also mounted on center stem 19 and associated with display 45, (ii) a "dash1 hand" indicated by the numeral 24 that is mounted on a stem and associated with display 40 and (iii) a "dash2 hand" indicated by the numeral 26 that is mounted on a stem 27 and associated with display 50. As will become clear below, not all hands 22, 24 and 26 need to be provided in each specific embodiment.

For reference, it can be seen that the hour hand and minute hand conveys time of day information, and, along with display hand 22, are rotatable about a center axis, while display hands 24 and 26 are rotatable about an axis other than the center axis. This use of display hands 24, 26 permits the use of additional displays without the need to utilize any of the center-mounted hands, such as the hour and/or minute hands.

2. Hand Movement System

Reference will now also be made to FIG. 2, wherein the embodiment illustrated in FIG. 1 will comprise four stepper motors, each respectively and generally indicated by M1, M2, M3 and M4. One skilled in the art would recognize that varying the number of displays and display hands can vary the number of needed stepper motors, all of which is within the scope of the present invention and disclosure.

As positioned in module 15, motor M1 is provided to rotate hour hand 18, minute hand 20 and "seconds" hand 21 all in a known manner. Specifically, hour hand 18, minute hand 20 and "seconds" hand 21 are coupled to a gear train, generally indicated at 61, for conveying the rotational activity generated by the rotor of motor M1.

In a similar manner, hand 22 is rotated by stepper motor M2, and a gear train generally indicated at 62 is provided to convey the rotational activity generated by the rotor of motor M2 to hand 22. Likewise, hands 24, 26 are each respectively rotated by stepper motors M3 and M4, and a gear train generally indicated at 63 is provided to convey the rotational activity generated by the rotor of motor M3 to hand 24, while a gear train generally indicated at 64 is provided to convey the rotational activity generated by the rotor of motor M4 to hand 26. The construction of the respective gear trains 61-64 are well within the purview of one ordinarily skilled in the art, although certain details thereof are disclosed below and illustrated in FIGS. 4-5 in connection with the autocalibration feature of the present invention.

Preferably, motors M2, M3 and M4 are bidirectional stepper motors thus being able to rotate in either direction, with as many as two rotor steps per revolution (or 180° per rotor step), and the construction of acceptable stepper motors to functionally operate in this manner are widely commercially available and well within the understanding of those skilled in the art. Preferably, motors M2-M4 are identically constructed. It should also be understood that it is well within the skill of the designer to design an appropriate gearing ratio to provide for the desirable display rotation or movement of display hands 22, 24, 26. That is, it may be desirable for the incremental rotation of the hands to be quire small, thus providing for precise increments and display measurements. For example, in the embodiment, which provides for display hand 22 to measure directional headings (i.e. a compass hand), it is desirable to have very precise movement of hand 22, such as in 1.2° increments. Thus the ratio of the gear train from its associated motor to display hand 22 may be 150. In other examples, such as in the other embodiments disclosed herein with regard to the accuracy of display hands 24 and 26, the ratio of the gear train from the respective motors may be 180, thus providing movement of the display hands in increments of 1°, especially, if by way of example and not limitation, a display scale of 100° degrees is used.

3. Circuit Composition and Hand Control

For purposes of brevity, reference should be had to application Ser. No. 10/441,417 for a detailed disclosure of preferred constructions and methodologies relating to the display hand control and associated circuit diagrams.

4. Autocalibration

Figure 4:
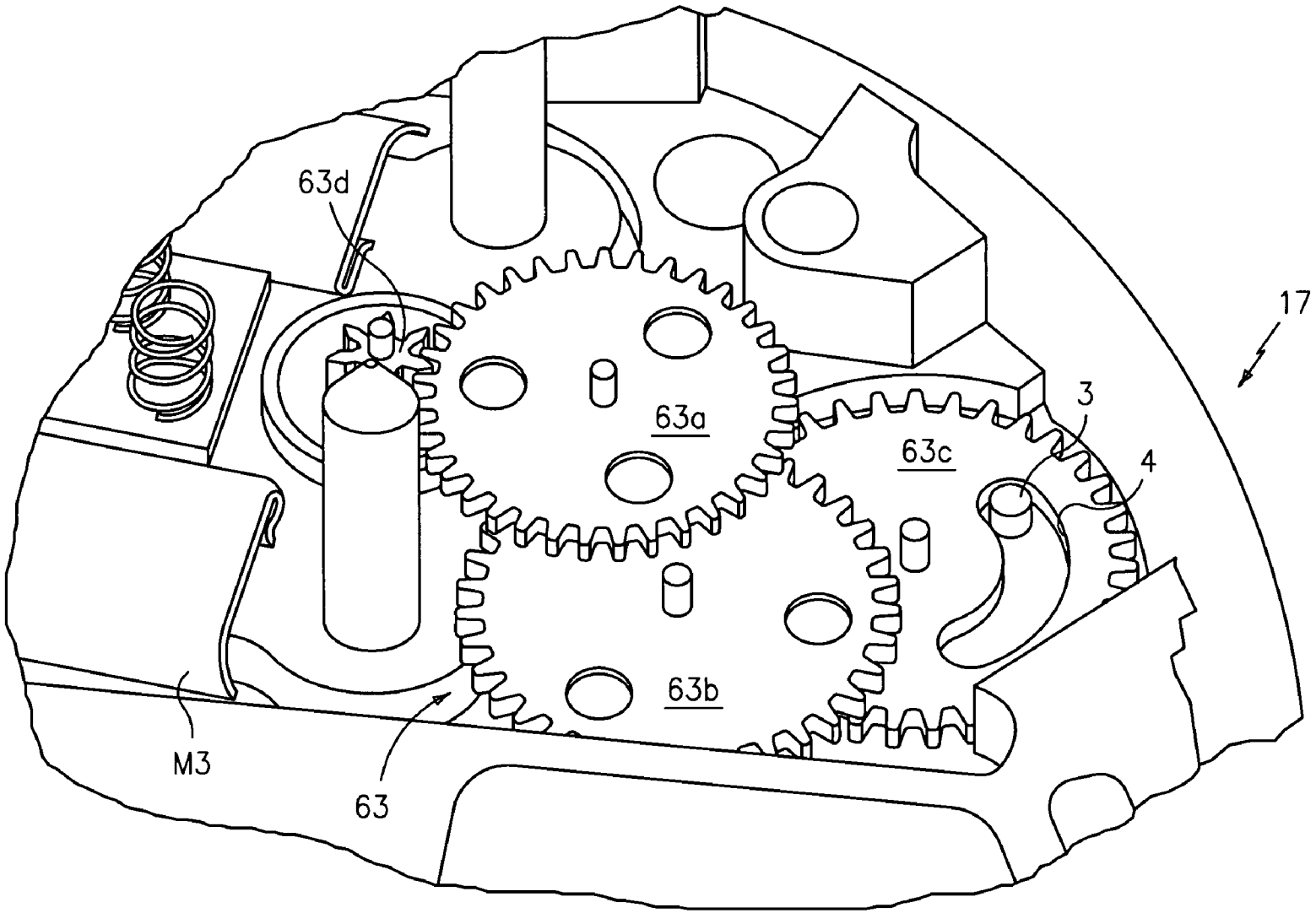
FIG. 4 is an enlarged view of the gear train for one of the non-center mounted display hands, such as display hand 24 or 26 illustrating a preferred construction for implementing the autocalibration feature of the present invention.
Figure 5:
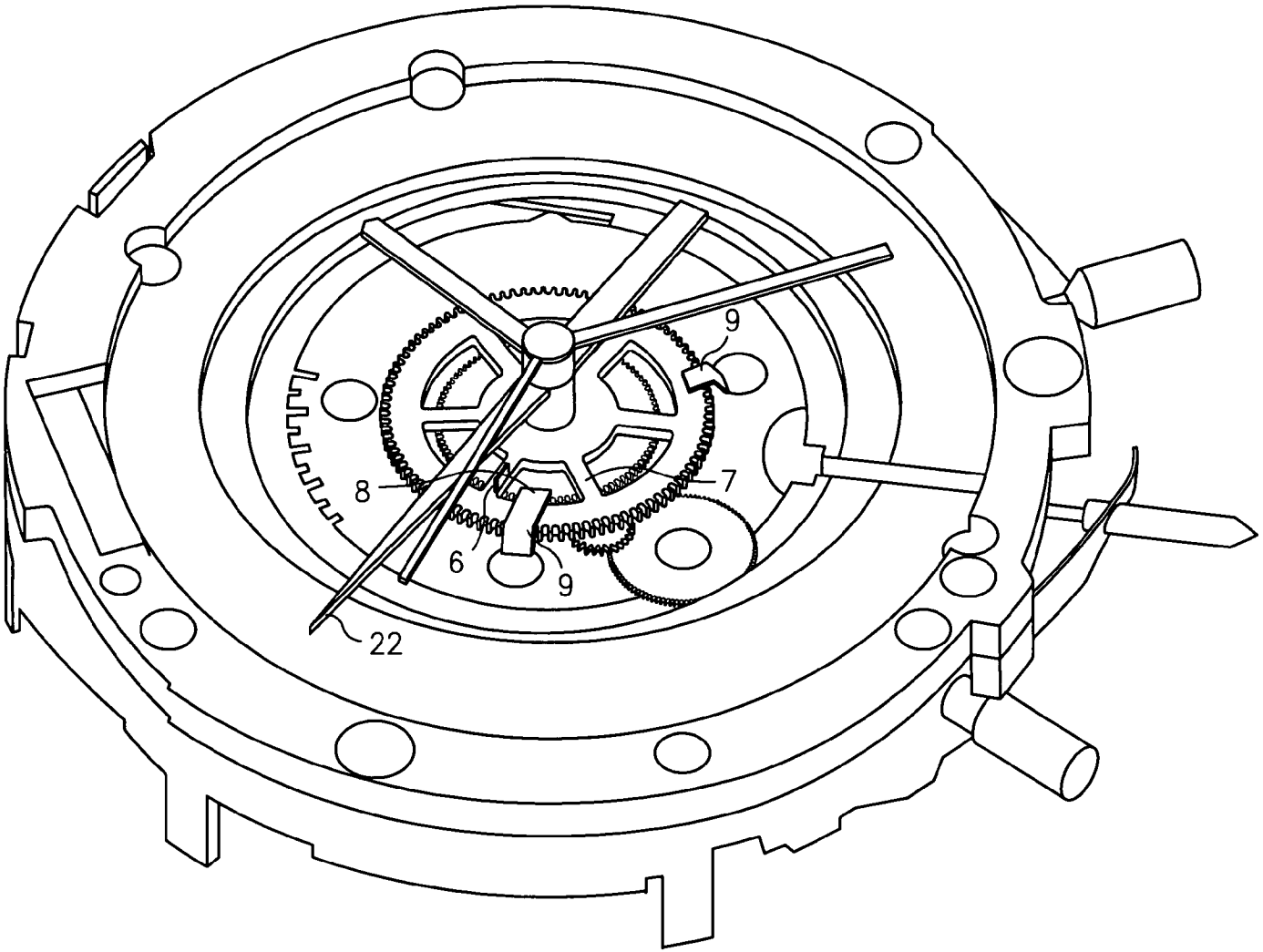
FIG. 5 is a perspective view showing an alternative embodiment of construction that can be used in combination with a preferred methodology to carry out the autocalibration feature of the present invention.

Reference is now made to FIGS. 3-5 for a disclosure of the preferred autocalibration methodology and corresponding preferred constructions to effectuate such autocalibration of one or more of the display hands 22, 24 and 26, all in accordance with the present invention.

Specifically, reference is first made to FIG. 4, which is an enlarged view of preferred gear train 63 for display hand 24. An identical gear train is utilized for gear train 64. As illustrated, gear train 63 comprises a first gear 63*a*, an intermediate gear 63*b* and a third gear 63*c*, which itself preferably includes stem 25 onto which display hand 24 is mounted. As would be well understood by one skilled in the art from a review of FIG. 4, but provided herein for completeness, the rotor of stepping motor M3, by way of a rotor gear 63*d*, meshes with the outer teeth (and thus causes the rotation) of first gear 63*a*. On the underside of first gear 63*a* is a pinion (not shown) which meshes with the outer teeth (and thus causes the rotation) of intermediate gear 63*b*. Similarly, a pinion (not shown) on the underside of intermediate gear 63*b* meshes with the outer teeth (and thus causes the rotation) of third gear 63*c*. Preferably, stem 25 is formed on the underside of third gear 63*c*.

In accordance with the particulars of a first embodiment of the autocalibration feature, it can be seen that part of housing 17 includes a raised tab 3 extending therefrom and into an arcuate channel 4 formed in third gear 63*c*. Channel 4 need only have a length sufficient to permit display hand 24 to sweep fully through the arc of the provided display (i.e. display 40). For example, FIG. 1 illustrates displays 40, 50 that would require about a ±70° arc through which a display hand would need to sweep to be able to indicate information at the extremes (i.e. the minimum and maximum) of the display.

The objective is therefore to provide a methodology to ensure that display hand 24 (or display hand 26 as the case may be) can be "parked" at a particular position, thereby providing the ability to recalibrate the position of the display hand, thus ensuring accurate displaying of information and providing the controller an easy way to "know" the location of the display hands, especially after calibration.

Specifically, it is preferable to rotate third gear 63*c* sufficiently to ensure that the edge of channel 4 is "pinned" against and abutting tab 3. Ensuring this sufficient rotation and "pinning" of channel 4 against tab 3 is achieved by rotating, and attempting to overrotate to some extent, third gear 63*c*. Doing so is achieved by trying to overrotate rotor gear 63*d* by several steps. It should be understood that trying to rotate rotor gear 63*d* when third gear 63*c* is already "pinned" will not damage the motor, i.e. motor M3. It should also be understood by those skilled in the art that once "pinned" by the methodology below, with bi-polar stepping motors it is advantageous to supply a defined number, such as at least two impulses for two steps in the forward direction. Then the motor is in a free rest position and the hand is in a defined position (e.g. zero position).

Before turning to the preferred methodology, it should be understood that several values must be stored in memory, such as in controller 100 (not shown but incorporated by reference from the aforementioned application. For example, the maximum number of steps needed from a zero position on the display to the maximum value on the display shall be stored in memory and shall be represented by the value of "s." This value of "s" represents the maximum number of steps that the rotor would have to make so that the display hand, should it be pointing to the maximum value of the display, could sweep back to the zero position. The number of steps needed from the zero position on the display to the position such that channel 4 in third gear 63*a* would be "pinned" up against tab 3 shall also be stored in memory and shall be represented by the value of "n." A mere precautionary predetermined number of additional steps, such as several, may also be stored and represented by the value of "p." Accordingly, it can be seen that the total number of steps, represented by the quantity "K," represents the total number of steps that it is desirable to rotate rotor gear 63*d* of motor M3 to ensure that third gear 63*a* has been rotated fully to its "end stop" position. Thereafter, as will be seen below, the rotor of motor M3 and hence third gear 63*c*, can be rotated in the opposite direction "n" steps to ensure that the hand is now at the zero position.

Specifically, with the counter value "count" initialized, the rotor of motor M3 is stepped a predetermined number of steps, such as 1. The counter is then incremented by one, and it is determined whether the counter is still less than the value of "K." If it is still less than "K", it is desirable to again step the rotor of motor M3 the predetermined number of steps, increment the counter by one, and again determine whether the counter is still less than the value "K." Until the counter value is equal to "K," the rotor of motor M3 will continue to be stepped.

On the other hand, once "count" equals "K" it can be assumed that the channel edge of channel 4 is pinned against tab 3, and gear 63*c* can rotate no further in the "zeroing" direction. Thereafter, the rotor of motor M3 is rotated in the opposite direction "n" steps to place display hand 24 at the zero position (see FIG. 1), at which point the autocalibration of a display hand would be complete. Again, for bidirectional motors with rotors that make 180° rotations per step, after having third gear 63*c* "pinned," it is advantageous to step the rotor 2 steps to ensure that the rotor is thereafter able to freely rotate.

The foregoing construction is most advantage when the rotation of the gear at issue, such as third gear 63*c*, is somewhat restricted, such as the aforementioned ±70° of rotation. With such a limited rotational sweep, channel 4 need not be too long and is quite easy to form therein. However, in the event that the display hand can sweep through a larger arc (such as in the case of a heartrate monitor where display hand 22 sweeps from about the 7:00 position to the 5:00 position (about 330°)), the channel and tab configuration of FIG. 4, although adequate, is less than preferred.

In this situation, with reference being made to FIG. 5, a more practical approach is to provide a tab 6 on the gear, such as gear 7, which rotates display hand 22. Such a tab may be formed of an upwardly bent piece of gear 7 itself. Since gear 7 is preferably made of metal, a simple bending of a corner thereof is quite easy. A corresponding stopper 8 may be formed on an extending member, such as brace member 9, or other stationary member in the module, which, at the end position, as defined above, would likewise "stop" the rotation of gear 7. As would now be understood, gear 7, part of the gear train that rotates display hand 22, can only rotate about a confined 330° since the edges of stopper 8 prevent further rotation thereof. The aforementioned methodology is equally applicable to this embodiment, since the same principles apply, the only difference being whether a tab and stopper arrangement is used or a tab and channel, as disclosed. Clearly however, both of the embodiments of FIGS. 4 and 5 will work for either gear, namely 63*c* or 7, the only difference being the desirability and/or practicality of forming an elongated channel around essentially the entire gear 7, especially when it is preferably made of metal.

A single push button or the like, operatively coupled to a controller such as controller 100 of the aforementioned application entitled "WEARABLE ELECTRONIC DEVICE WITH MULTIPLE DISPLAY FUNCTIONALITY", can be used to initiate the automatic calibration operation disclosed herein. Such operative coupling of the push button to the controller is well within the purview of one ordinarily skilled in the art.

It can thus be seen that such an autocalibration feature is quite advantageous and novel over the known prior art, in which a display hand, such as a chronograph hand for example, needs to be calibrated by manual movement of the hand to the desired "0" position. The present invention overcomes this deficiency by providing autocalibration (or "zeroing" of the hand with one push of a button, or the like).

While the invention has been particularly shown and described with respect to preferred embodiments thereof, it will be understood by those skilled in the art that changes in form and details may be made therein without departing from the scope and spirit of the invention.

What is claimed is:

1. A method of calibrating a display hand in an electronic device, wherein the display hand conveys information on a display and is operatively coupled to a rotor of a stepping motor via one or more gears, the method comprising the steps of:

initializing a counter;

stepping the rotor of the stepping motor a number of steps in a first direction and incrementing the counter;

determining whether the counter is less than a predefined value representing at least the total of (i) the maximum number of steps needed to rotate the display hand from an initial position on the display to a position such that the display hand would indicate the maximum value on the display; and (ii) the number of steps needed to rotate the display hand from the initial position on the display to the position such that a channel formed in one of the one or more gears would abut against a tab;

and if so:

stepping the rotor of the stepping motor a number of steps in the first direction, incrementing the counter and again determining whether the counter is less than the predefined value;

and if not:

rotating the rotor of the motor in a direction opposite the first direction the same number of steps needed from when the display hand would be at the initial position on the display to the position such that the channel would abut against the tab.

2. A method of calibrating a display hand in an electronic device, wherein the display hand conveys information on a display and is operatively coupled to a rotor of a stepping motor via one or more gears, the method comprising the steps of:

initializing a counter;

stepping the rotor of the stepping motor a number of steps in a first direction and incrementing the counter;

determining whether the counter is less than a predefined value representing at least the total of (i) the maximum number of steps needed to rotate the display hand from an initial position on the display to a position such that the display hand would indicate the maximum value on the display; and (ii) the number of steps needed to rotate the display hand from the initial position on the display to the position such that a tab on one of the one or more gears would abut against a stopper;

and if so:

stepping the rotor of the stepping motor a number of steps in the first direction, incrementing the counter and again determining whether the counter is less than the predefined value;

and if not:

rotating the rotor of the motor in a direction opposite the first direction the same number of steps needed from when the display hand would be at the initial position on the display to the position such that the tab would abut against the stopper.

3. A calibration assembly for use in an electronic timepiece, wherein the calibration assembly is for initializing the position of a display hand that conveys information displayable on the timepiece, the calibration assembly comprising:

a stepper motor for rotating the at least one display hand in at least one of a clockwise and counterclockwise direction in predefined increments;

one or more gears for operatively coupling the rotor of the stepper motor to the display hand, wherein a channel is formed within at least one of the one or more gears and wherein a tab is provided and positioned to be abuttable against an edge of the channel; and means, operatively coupled to the stepper motor, for causing the rotor of the stepper motor to rotate in a first direction a number of steps that is at least the total of (i) the maximum number of steps needed to rotate the display hand from an initial position on the display to a position such that the display hand would indicate the maximum value on the display and (ii) the number of steps needed to rotate the display hand from the initial position on the display to the position such that the channel abuts against the tab and thereafter, for causing the rotor of the stepper motor to rotate in a direction opposite the first direction the same number of steps needed from when the display hand would be at the initial position on the display to the position such that the channel abuts against the tab;

wherein the rotor of the stepping motor:

rotates in the first direction the number of steps that is at least the total of (i) the maximum number of steps needed to rotate the display hand from an initial position on the display to a position such that the display hand would indicate the maximum value on the display and (ii) the number of steps needed to rotate the display hand from the initial position on the display to the position such that the channel abuts against the tab, further rotates a predetermined number of additional steps in the first direction, and thereafter, rotates in the direction opposite the first direction the same number of steps needed from when the display hand would be at the initial position on the display to the position such that the channel abuts against the tab.

4. The calibration assembly as claimed in claim 3, wherein the tab is an integral part of the housing of the timepiece.

5. The calibration assembly as claimed in claim 3, wherein the means, after the display hand has been placed in the initialized position, provides signals for rotating the rotor of the stepping motor in a direction opposite the first direction a predetermined number of steps so as to position the display hand to indicate an initial value.

6. The calibration assembly as claimed in claim 5, wherein the predetermined number of steps is the number of steps needed from the position such that the display hand is indicating the initial value to the position such that the channel would abut against the tab.

7. A calibration assembly for use in an electronic timepiece, wherein the calibration assembly is for initializing the position of a display hand that conveys information displayable on the timepiece, the calibration assembly comprising:

a stepper motor for rotating the at least one display hand in at least one of a clockwise and counterclockwise direction in predefined increments;

one or more gears for operatively coupling the rotor of the stepper motor to the display hand, wherein at least one of the one or more gears includes a tab extending therefrom and wherein a stopper is provided and positioned to be abuttable against the tab;

means, operatively coupled to the stepper motor, for causing the rotor of the stepper motor to rotate in a first direction a number of steps that is at least the total of (i) the maximum number of steps needed to rotate the display hand from an initial position on the display to a position such that the display hand would indicate the maximum value on the display and (ii) the number of steps needed to rotate the display hand from the initial position on the display to the position such that the tab abuts against the stopper and thereafter, for causing the rotor of the stepper motor to rotate in a direction opposite the first direction the same number of steps needed from when the display hand would be at the initial position on the display to the position such that the tab abuts against the stopper;

wherein the rotor of the stepping motor:

rotates in the first direction the number of steps that is at least the total of (i) the maximum number of steps needed to rotate the display hand from an initial position on the display to a position such that the display hand would indicate the maximum value on the display and (ii) the number of steps needed to rotate the display hand from the initial position on the display to the position such that the tab abuts against the stopper, further rotates a predetermined number of additional steps in the first direction, and thereafter, rotates in the direction opposite the first direction the same number of steps needed from when the display hand would be at the initial position on the display to the position such that the tab abuts against the stopper.

8. The calibration assembly as claimed in claim 7, wherein the stopper is coupled to the housing of the timepiece.

9. The calibration assembly as claimed in claim 7, wherein the means, after the display hand has been placed in the initialized position, provides signals for rotating the rotor of the stepping motor in a direction opposite the first direction a predetermined number of steps so as to position the display hand to indicate an initial value.

10. The calibration assembly as claimed in claim 9, wherein the predetermined number of steps is the number of steps needed from the position such that the display hand is indicating the initial value to the position such that the tab would abut against the stopper.

* * * * *